United States Patent [19]

Raulerson et al.

[11] Patent Number: 4,485,584

[45] Date of Patent: Dec. 4, 1984

[54] IGNITABLE FUEL AND FIRE STARTING COMPOSITION

[75] Inventors: James Raulerson; Thomas J. Raulerson, both of Macclenny, Fla.

[73] Assignee: Raulerson Products Manufacturing Company, Inc., Macclenny, Fla.

[21] Appl. No.: 522,698

[22] Filed: Aug. 12, 1983

[51] Int. Cl.[3] ..... C10L 9/10

[52] U.S. Cl. ..... 44/66; 44/14; 44/38; 44/41

[58] Field of Search ..... 44/66, 6, 14, 20, 22, 44/34, 38, 40, 41

[56] References Cited

U.S. PATENT DOCUMENTS

| | | | |
|---|---|---|---|
| 88,075 | 3/1869 | Reed | 44/22 |
| 2,059,208 | 11/1936 | Chaney | 44/41 |
| 2,107,054 | 7/1935 | Haymond | 44/41 |
| 2,227,256 | 12/1940 | Haffner | 44/40 |
| 2,477,174 | 7/1949 | Fosnaess | 44/22 |
| 2,854,321 | 9/1958 | Stanton | 44/39 |
| 2,976,133 | 3/1961 | Stueler | 44/24 |
| 3,232,720 | 2/1966 | Kepple | 44/7 |
| 3,279,900 | 10/1966 | Naples | 44/40 |
| 3,351,444 | 11/1967 | Ryan | 44/41 |
| 3,395,003 | 7/1968 | Alexander | 44/68 |
| 3,726,652 | 4/1973 | Schick | 44/14 |
| 3,849,323 | 11/1974 | Hollinshead | 44/66 |
| 4,272,252 | 6/1981 | Altman | 44/40 |

FOREIGN PATENT DOCUMENTS

| | | | |
|---|---|---|---|
| 115665 | 7/1926 | Switzerland | 44/34 |

*Primary Examiner*—William R. Dixon, Jr.
*Assistant Examiner*—Margaret B. Medley
*Attorney, Agent, or Firm*—Memel, Jacobs, Pierno & Gersh

[57] ABSTRACT

An ignitable kindling material and cooking fuel which is dry to the touch, non-tacky and essentially odor free is provided by impregnating a combustible cellulosic matrix, such as a wood fiber insulating board, with a liquid impregnant made up of specified proportions of a paraffin wax, a motor oil, a mineral oil and animal fat.

6 Claims, 2 Drawing Figures

IGNITABLE FUEL AND FIRE STARTING COMPOSITION

FIELD OF THE INVENTION

This invention relates to ignitable materials which can themselves be used as a cooking fuel and which can also be used to kindle fires fueled by other materials. More particularly, this invention relates to an ignitable fuel composition which is compact, nonexplosive, odor-free, nontacky (and in fact dry to the touch), easily handled and easily ignited.

BACKGROUND OF THE INVENTION

Solid fire starting materials such as paper, twigs or sticks, pine cones or pinewood, and the like are customarily used as kindling to ignite other, longer-burning materials, principally wood, coal or charcoal briquettes. Such solid fire starting materials are generally safer than most liquid petroleum based fire starting materials, but are not without difficulties themselves, among which is a tendency to burn up before igniting the primary fuel.

Numerous attempts have been made to provide improved solid fire starting materials. For example, U.S. Pat. No. 4,272,252, issued June 9, 1981 to Altman, discloses a fire starting material comprising a rectangular block of porous cellulosic fiber board, such as cellulosic fiber insulating board, including such boards coated on one side with asphalt, made up of individual squares which can be broken off and soaked with mineral spirits (or "a combustible, volatile petroleum distillate"). The block is sealed within a burnable, multilayered envelope which is impervious to mineral spirit vapors, the envelope being made up of at least one cellophane layer to aid in the envelope's burning and at least one polyethylene layer to retard the envelope's burning. Similarly, U.S. Pat. No. 3,279,900, issued Oct. 18, 1966 to Naples, discloses a fire starting material for igniting charcoal comprising wood pulp, compressed wood fiber or felted fibrous pulp pressed into an approximately one half inch thick pad, containing cylindrical perforations or draft holes and impregnated with paraffin wax in an amount of about 10 to 20% of the total weight of the pad, while U.S. Pat. No. 3,395,003, issued July 30, 1968 to Alexander, also discloses a fire starting material made of a web, sheet or mat of wood pulp paper which is first dipped in hickory oil, then dried and treated in successive baths of citronella and paraffin oil. Such mats may be made up of repeated shapes supplied in a single structure so that portions of the structure may be broken away for use as kindling.

U.S. Pat. No. 3,726,652, issued Apr. 10, 1973 to Schick, discloses the use of a combustible solid fibrous material, such as Celotex fiber board, which has been impregnated with an oxidizing agent and a binder such as paraffin wax, as an ignition cap for a "primary combustible solid" such as petroleum coke.

Other prior art fire starting or kindling materials are disclosed in U.S. Pat. No. 3,351,444, issued Nov. 7, 1967 to Ryan et al, U.S. Pat. No. 2,854,321, issued Sept. 30, 1958 to Stanton, U.S. Pat. No.2,227,256, issued Dec. 31, 1940 to Haffner and U.S. Pat. No. 2,059,208, issued Nov. 3, 1936 to Chaney.

Another method used in the prior art to improve the ignition qualities of more difficultly ignitable fuels such as wood, coal and charcoal briquettes, particularly for cooking purposes, is to impregnate them with liquid flammable materials. If volatile materials are used as the impregnants, they tend to volatilize off while burning before igniting the primary fuel, and in any event introduce a serious safety hazard. Non-volatile impregnants—waxes or other paraffinic materials, for example—often do not provide enough heat by themselves, or ignite too slowly, to maintain combustion in the primary fuel. Disclosures relating to impregnating solid fuels with such materials can be found, for example, in U.S. Pat. No. 3,232,720, issued Feb. 1, 1966 to Kepple, U.S. Pat. No. 2,976,133, issued Mar. 21, 1961 to Stueler, and U.S. Pat. No. 2,107,054, issued July 24, 1935 to Haymond.

BRIEF DESCRIPTION OF THE INVENTION

The present invention provides an ignitable fuel and fire starting composition which is compact, nonexplosive, odor-free, non-volatile, smokeless, non-tacky (and in fact dry to the touch), easily handled, easily ignited and able to generate enough heat and burn for a long enough time so that it is capable of functioning, by itself, as a convenient source of cooking heat as well as an excellent kindling material for igniting primary fuels for cooking. This fuel and fire starting material comprises a cubic, rectilinear or other suitably-shaped three dimensional porous, impregnatable, combustible structure or matrix formed from a cellulosic material, preferably a combustible cellulosic fiber insulating board such as Celotex fiber board, and will preferably contain repeated attached shapes of any suitable configuration—squares, rectangles, diamonds, etc.—which may be individually broken away from the entire structure. Any irregular or jagged edges around such broken-away pieces coming from the connections between such pieces in the unbroken structure aid in providing rapid ignition once the pieces are contacted with a flame. The entire structure or matrix, whose function in the present invention is, in part, somewhat similar to that of a wick in a candle, is impregnated with a mixture made up of specified proportions of a paraffin wax, a motor oil, a mineral oil and an animal fat. This impregnated mixture is non-volatile and non-explosive, and when used in accordance with the teachings of the present invention to impregnate a suitable matrix, results in a fire starting material which is, as indicated above, non-tacky and dry to the touch. As a result, the impregnated structure is easily shipped, stored and handled, and there is no need to encase it in cellophane or other oil-impervious wrapping materials since there are no exuding liquid impregnants to contain. Furthermore, the impregnated structure, when lit, does not give off odors, smoke or dangerous fumes.

DESCRIPTION OF THE ILLUSTRATED EMBODIMENTS

DETAILED DESCRIPTION OF THE INVENTION

The cellulosic material from which the impregnatable matrices of the present invention is formed can be any porous, impregnatable, formable, combustible cellulosic material. Preferably, a combustible wood fiber insulating board such as a Celotex fiber board or the like will be employed, but boards made of any other combustible cellulosic material, for example vegetable fiber materials other than wood fibers, such as sugar cane fibers and the like, can also be used. Commercially available cellulosic fiber insulating boards coated on at least one side with asphalt or other combustible coatings can be used, if desired, so long as the other side or the edges are left uncoated to permit them to absorb the impregnating mixture.

The porosity of the unimpregnated matrix can vary within rather wide limits, depending on the extent to which the cellulosic fibers are compressed when forming the board. For example, typical combustible wood fiber insulating boards will be more porous than boards made of sugar cane fibers. Ordinarily, the unimpregnated matrix will range in weight from somewhat less than about one pound to somewhat more than 1.5 pounds per square foot, and preferably from 1 to 1.5 pounds per square foot, and ordinarily will range in thickness from about 0.25 to about 1 inch, and preferably will be about 0.5 inch thick across its thickest portion or portions. Neither the porosity or density nor the thickness or any other dimension of the impregnatable matrix is particularly critical, so long as the matrix is sufficiently thick to hold the impregnating mixture and sufficiently porous to permit it to be impregnated, preferably throughout, inasmuch as adjustments can be made in the length of time the matrix is immersed in the impregnating mixture to take such factors into account.

Figure 1:
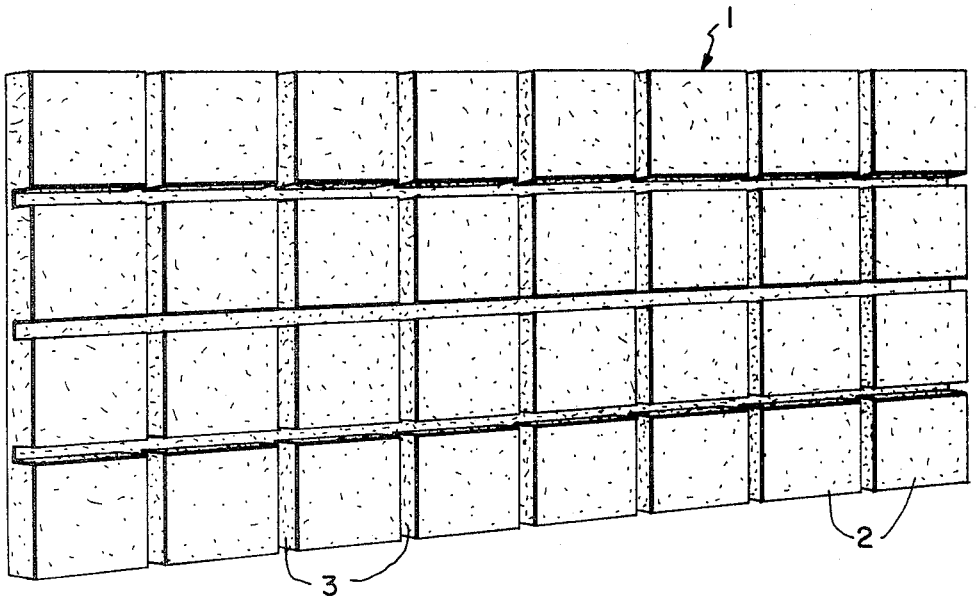
FIG. 1 is an elevated plan view of a fire starting material embodying the present invention.
Figure 2:
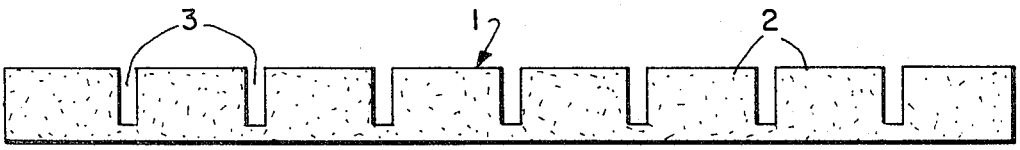
FIG. 2 is a side view of the fire starting material of FIG. 1.

As stated above, the matrix will preferably contain repeated attached shapes of any suitable configuration, e.g., the squares 2 shown in the matrix 1 illustrated in FIGS. 1 and 2, formed by means of the channels or grooves 3 in the matrix, which may be individually broken away from the entire structure or matrix. Such shapes, e.g., the squares 2 in the matrix 1 illustrated in FIGS. 1 and 2, may be formed by molding or pressing, embossing, milling, scoring, routing or otherwise imparting the desired pattern into an unimpregnated cellulosic matrix by methods well known in the art.

In a particularly preferred embodiment of the present invention, the matrix will be rectangular in shape, approximately 8 inches long by 4 inches wide by ½ inch thick, divided into thirty two ¾ inch square detachable sections. It has been found that two of such ¾ inch squares, impregnated as described hereinbelow, will burn for about ten minutes, and that from about four to five of such ¾ inch impregnated squares can be used as kindling for an appropriate filling of charcoal briquettes (about five pounds) in the average home barbeque. From two to eight of such ¾ inch impregnated squares ordinarily will be sufficient to ignite a typical load of wood in a fireplace or a wood burning stove, depending on the type of wood being burned and its degree of dampness, while two to four of such ¾ inch impregnated squares will quickly ignite a campfire.

Two of such ¾ inch impregnated squares ignited under a 6 inch frying pan will fry two eggs well done, while the flame from four to six of such ¾ inch impregnated squares, kept within three inches from the bottom of the pan, will fry 5–6 slices of breakfast bacon.

Of course, it will be appreciated that the actual number of such impregnated squares, or any other shape or thickness of impregnated matrix prepared in accordance with the present invention, that can be used for kindling or as the sole cooking fuel will vary depending on such factors as the size of the impregnated matrix portion(s), the cooking utensil or receptacle used, the kind and amount of other fuel (if any) employed, etc.

As indicated above, the impregnating liquid used to impregnate the aforementioned matrices to produce the ignitable materials of the present invention comprises a mixture of four specified ingredients used in specified proportions to make up the impregnating liquid. These ingredients, and the percentages in which they can be used to make up the impregnating liquid (said percentages being by weight based, in each case, on the total weight of the impregnating liquid) are:

1. A paraffin wax, such as Amoco Askar Wax No. R35, or the like, which will be used in amounts ranging from about 88% to about 94%.

2. A motor oil, preferably a non-detergent motor oil such as Exxon 10 W.N.D. Motor Oil, or the like, which will be used in amounts ranging from about 2% to about 6%. It has been found that non-detergent motor oils give off less objectionable odor than do detergent-containing motor oils when the impregnated matrix is ignited.

3. A mineral oil, such as Exxon Marcol Mineral Oil No. 52, or the like, which will be used in amounts ranging from about 2% to about 3%.

4. An animal fat, such as beef or pork fat, sheep tallow, or the like, which will be used in amounts ranging from about 2% to about 3%.

The impregnating liquid is prepared from these ingredients by first melting the paraffin wax and then simply stirring in the remaining ingredients while heating to a suitably elevated temperature, e.g., from about 180° to about 200° F. at atmospheric pressure. Similarly, impregnation of the matrix with the impregnating liquid can be carried out at any temperature at which the impregnant is in the liquid state, again preferably at a temperature of from about 180° to about 200° F. at atmospheric pressure, by simply dipping the combustible matrix into an open vat of the liquid impregnant and allowing the matrix to remain in contact with the impregnant for a time sufficient to permit the matrix to be impregnated and preferably saturated with the impregnant. This impregnating time will preferably be insufficient to allow the matrix to soak up so much impregnant that when it is removed from contact with the impregnant, excess impregnant will drip from or run out of the interior of the matrix while it is being allowed to cool, since this is a waste of the impregnating liquid.

The impregnating time will vary, depending on such factors as the porosity or density of the matrix, its thickness, whether or not one or more sides of the matrix have previously been coated with asphalt or a similar material, and can be determined by simple observation of matrices left in contact with the impregnating liquid for varying periods of time and then removed from the impregnating liquid and allowed to cool. In general, however, ordinarily obtainable matrices, e.g., Celotex fiber board or the like, of from about ½ to about 1 inch in thickness will be impregnated throughout by dipping them into an open vat of the impregnating liquid and allowing them to remain in contact with the impregnant at about 180° to about 200° F. for from about three to about eight seconds, and preferably for about 4–5 seconds. Under these conditions, the matrix will be saturated with the impregnant and will increase in weight, by virtue of impregnation throughout its mass, as much as about 100–120% or more.

Other impregnating methods within the skill of the art, including painting or roller coating, spraying, pressure impregnating or the like can also be used, if desired, to impregnate, and preferably saturate, the matrix with the liquid impregnant.

In order that those skilled in the art can more fully understand the present invention, the following example is set forth. This example is given solely for purposes of illustration, and should not be considered as expressing limitations unless so set forth in the appended claims. All parts are by weight.

EXAMPLE 1

A liquid impregnant mixture of:

545 parts of Amoco Eskar Wax #R34 (a paraffin wax)

27 parts of Exxon 10 W.N.D. Motor Oil 14 parts of Exxon Marcol Mineral Oil #52

14 parts of beef fat was prepared by first heating the wax in a steel vat until it melted, then adding the remaining three constituents, with stirring, while heating to 180°-200° F.

This mixture was then used to impregnate 8 inch by 4 inch by ½ inch thick slabs of Celotex wood fiber insulation board, each weighing 2.5 ounces, which had been scored using carbide tipped circular saw blades to form thirty two ¾ inch squares in each slab, by placing the slabs on a wire tray, dipping the tray below the surface of the heated impregnant liquid for 4 seconds, and then removing the tray and allowing the impregnated slabs to cool to room temperature.

The thus-obtained impregnated Celotex slabs each weighed approximately 5.5 ounces, and were dry to the touch, non-tacky and essentially odor free.

Four impregnated ¾ inch squares broken from one of these slabs were ignited instantly by simply holding a match to them, and were sufficient to kindle approximately 5 pounds of charcoal briquettes in a home barbecue within approximately 10–15 minutes.

It has been found that the paraffin wax which makes up the major part of the impregnating liquid cannot be used by itself to impregnate the combustible matrix satisfactorily. If a paraffin wax is used alone, not only is it extremely difficult to break the wax-impregnated matrix, e.g., a wax-impregnated wood fiber insulating board, into useable pieces, whether or not the matrix has previously been formed into repeating shapes by scoring or any other convenient method, but the wax-impregnated matrix, although it burns well once ignited, does not ignite as readily as do matrices impregnated in accordance with the teachings of the present invention.

Similarly, impregnating a combustible matrix with a motor oil alone gives a material that is too soft and sticky to be handled with ease, and that gives off too much smoke when ignited. A motor oil used as part of the impregnating liquids of the present invention facilitates the breaking of individual pieces from an impregnated matrix, particularly one that has been formed into a multiplicity of repeating shapes.

Using a mineral oil alone gives an impregnated matrix that lights quickly and burns well, but is so greasy that it cannot be packaged without using a cellophane or other mineral oil-impervious envelope or wrapping.

Animal fat used alone as the impregnant gives a matrix that burns longer than those impregnated with either a motor oil or a mineral oil. An animal fat-impregnated matrix, however, does not light easily, and gives off an unpleasant animal fat odor.

It will be obvious to those skilled in the art that other changes and variations can be made in carrying out the present invention without departing from the spirit and scope thereof as defined in the appended claims.

We claim:

1. A fuel composition in the form of a three dimensional combustible matrix comprising a combustible cellulosic material, impregnated with an impregnating liquid comprising from about 88% to about 94% of a paraffin wax, from about 2% to about 6% of a motor oil, from about 2% to about 3% of a mineral oil, and from about 2% to about 3% of an animal fat, the percentages of each of the components of said impregnating liquid being by weight, based on the total weight of said impregnating liquid.

2. A fuel composition as described in claim 1 wherein said cellulosic material is a wood fiber insulating board.

3. A fuel composition as described in claim 2 wherein said wood fiber insulating board is between about 0.25 inch and about 1 inch thick across its thickest portion.

4. A fuel composition as described in claim 3 wherein said wood fiber insulating board is coated on one side with asphalt.

5. A fuel composition as described in claim 1 wherein said animal fat is beef fat.

6. A fuel composition as described in any one of claims 2–5 wherein said matrix contains repeated attached shapes which may be individually broken away from said matrix.

* * * * *